US006051619A

United States Patent [19]

Brandt

[11] Patent Number: 6,051,619

[45] Date of Patent: Apr. 18, 2000

[54] INVESTMENT CASTING COMPOSITION AND METHOD FOR MAKING THE SAME

[76] Inventor: M Karl Brandt, P.O. Box 1791, Lexington, S.C. 29071

[21] Appl. No.: 09/304,253

[22] Filed: May 3, 1999

[51] Int. Cl.[7] ..... C08J 9/00

[52] U.S. Cl. ..... 521/93; 164/34; 164/526; 521/97

[58] Field of Search ..... 521/93, 97; 164/34, 164/526

[56] References Cited

U.S. PATENT DOCUMENTS

| | | | |
|---|---|---|---|
| 4,306,036 | 12/1981 | Corbett | 521/147 |
| 4,307,202 | 12/1981 | Corbett | 521/79 |
| 4,874,030 | 10/1989 | Kuphal et al. | 521/134 |
| 4,946,884 | 8/1990 | Kuphal et al. | 521/134 |
| 5,176,188 | 1/1993 | Quinn et al. | 164/34 |
| 5,223,546 | 6/1993 | Morita | 521/79 |
| 5,364,889 | 11/1994 | Quinn et al. | 522/71 |

*Primary Examiner*—Morton Foelak
*Attorney, Agent, or Firm*—Michael A Mann; Nexsen Pruet Jacobs Pollard LLP

[57] ABSTRACT

A foamable, ashless investment casting replica composition comprises a foaming compound and a polymer. The foaming compound contains an ammonium salt of a polycarboxylic acid, at least one suspending agent, and may contain at least one carrier resin. During the molding of the replica, the foamed composition avoids shrinkage and thereby maintains its intended shape. In addition, thermal decomposition of the foaming compound yields only volatile gases and therefore leaves no ashes on the interior surface of the ceramic mold.

5 Claims, No Drawings

INVESTMENT CASTING COMPOSITION AND METHOD FOR MAKING THE SAME

BACKGROUND OF THE INVENTION

1. Field of the Invention

The present invention relates generally to compositions for use in investment casting. More particularly, the present invention is an ashless, foamable investment casting composition which yields a smooth interior mold surface.

2. Discussion of Background

Investment casting is a well known industrial procedure used in the manufacture of various metal parts, usually ones having intricate shape such as aerospace or automotive parts and military applications. Investment casting is also used for the manufacture of plumbing fixtures, air conditioner compressor parts and various consumer goods. In this procedure, a series of replicas, normally made of a wax-based composition or a sand and binder composition, are made in the shape of the part to be created. This replication is accomplished by heating and subsequently pouring the wax-based or sand and binder composition into a metal mold and allowing the replicas to cool. Once the replicas are fully cooled, they are removed from the metal mold. These replicas are then dipped into a slurry of refractory mold material, or otherwise coated, to form a refractory shell about the replicas. The constituents of the slurry are of a small particle size so that a fine interface surface is established. After the refractory shell is dried, it is dipped in a second refractory slurry, composed of larger sized particles, to give the shell adequate thickness and handling strength. Once the ceramic mold is completely dried, it is subjected to a thermal schedule. During this heating process, the replicas are "burned out" of the mold, leaving a cavity in the shape of the part to be manufactured. After the replicas are removed, molten metal is poured into the cavities of the ceramic mold to form the parts in the desired shape. After the metal cools and hardens the ceramic mold is removed by cracking or breaking.

One problem encountered in the art of investment casting is improperly shaped final parts. When the heated replica composition is introduced to the metal mold, and subsequently allowed to cool, thermal contraction takes place and the hardening replica shrinks from the interior sides of the mold. This shrinking causes the replica to loss its geometrical integrity and often causes the replica to lose its shape. As a result, many ceramic molds fail to maintain proper dimensions, which in turn results in inadequately shaped parts that fail to meet specifications.

Another problem currently faced by the industry is irregularities in the surface surrounding the cavity of the mold. These surface irregularities are formed during the sintering process and are the result of ashes (generated by burning replicas) that lay on, or are imbedded into, the ceramic mold. These ashes leave indentations, which in turn result in surface defects in the final metal part. These defects often prevent the metal part from meeting required specifications and tolerances, which in turn increases production costs.

Still another problem encountered by the industry is cracking of the ceramic mold during the "burning out" phase. When the replica, positioned within the ceramic mold, is subjected to heat, thermal expansion of the replica causes the exertion of a pressure about the interior of the ceramic mold. This pressure, if not alleviated, often causes the ceramic mold to crack. This premature cracking causes an increase in both production time and costs.

Therefore, there exists a need for an ashless, foamable investment casting composition.

SUMMARY OF THE INVENTION

According to its major aspects and briefly stated, the present invention is an ashless, foamable composition for use in making replicas for investment casting and a method for making the composition. More specifically, the present invention is a composition comprising between 0. 1 % and 10% by weight of a foaming compound and between 90% and 99.9% of a polymer. The foaming compound comprises an ammonium salt of a polycarboxylic acid, in combination with a carrier resin, a suspending agent or a combination thereof. The foaming compound may also include a quantity of ammonium bicarbonate.

To form the foaming compound, between 75% and 99.9% by weight of the carrier resin, suspending agent, or combination thereof is mixed with between 0. % and 25% by weight of an ammonium salt of a polycarboxylic acid. These constituents are mixed until a homogenous foaming compound is achieved. Thereafter, between 90% and 99.9% by weight of a polymer is added to between 0.1% and 10% of foaming compound and mixed until a homogeneous mixture is obtained. The polymer may be added to the foaming compound in a controlled manner or on a continuous basis. The mixture is then fed into an extrusion or injection apparatus and elevated to a temperature between approximately 80° C. and 280° C. During extrusion, the ammonium salt of the polycarboxylic acid will undergo a decomposition reaction to form $H_2O$, $CO_2$ and $NH_3$. Upon exiting the extruder die and entering the metal mold, the rapid decrease in pressure will cause the $H_2O$ , $CO_2$ and $NH_3$ to form gaseous bubbles within the polymeric compound. Thereafter, the composition fills the voids within the mold, in accordance with the desired final shape using normal investment casting procedure. As the replica cools to a temperature below 90° C., the $H_2O$, $CO_2$ and $NH_3$ will form an ammonium carbonate compound, while leaving the bubbles within the polymer. These bubbles exert a continuous pressure in the metal mold and prevent the polymer from shrinking.

Alternatively, prior to the addition of the polymer compound, the foaming compound can be pelletized by subjecting it to a thermal schedule of between 35° C. and 90° C. and subsequently pelletizing in accordance with normal industry procedure. Thereafter, the foaming compound may be stored and subsequently introduced to a polymer component and extruded as outlined above.

A primary feature of the present invention is the use of a foaming compound to form a replica composition for investment casting. The bubbles formed by the foaming agent, upon injection of the replica composition into the metal mold, cause a force to be exerted on the polymeric material toward the interior surface. This in turn prevents the mold from shrinking and thus losing its geometrical integrity. Consequently, the ceramic mold suffers less distortion which in turn assures that the dimensions of the molded parts remain within specifications, thereby reducing the occurrence of defective parts.

Another advantage gained by the use of a foaming agent is the reduction of pressure exerted by the polymer as it expands on melting during the "burn out" phase of the investment casting procedure. When the replica is "burned out" of the ceramic mold, the gaseous bubbles residing within the replica allow the polymer to compress the bubbles rather than exert a pressure on the ceramic mold. This reduction in hydraulic pressure prevents the ceramic molds from cracking.

Still another feature of the present invention is the use of an ammonium salt of a polycarboxylic acid as a foaming agent for a replica composition. When the replica is "burned out" of the ceramic mold, the ammonium carbonate compound decomposes into gaseous $H_2O$, $CO_2$ and $NH_3$. As a result, the ceramic surface surrounding the cavity remains free of ash fragments which produce surface imperfections in the final metal product. Consequently, the metal parts fall within specifications without the need for surface polishing, which in turn reduces production costs.

Other features and their advantages will be apparent to those skilled in the art from a careful reading of the Detailed Description of Preferred Embodiments.

DETAILED DESCRIPTION OF PREFERRED EMBODIMENT

The present invention is a foamable composition for making polymeric replicas for investment casting and a method for making the composition. The present invention advances a composition which, when molded into the desired shape, contains a plurality of bubbles dispersed throughout the polymeric material. As a result of the thermal cooling process, the bubbles within the polymer migrate to the hot areas to hold the polymer shape. When heated to a temperature above approximately 90° C., gases released into the bubbles exert a force on the polymeric material, which in turn preserves the size of the replica and assures a properly dimensioned ceramic coating. Additionally, the foaming agent contains only volatile chemical groups and thus, upon burnout, the replica leaves no ashes on the ceramic surface.

According to the present invention, the investment casting replica composition comprises a foaming compound and a polymer. The foaming compound comprises one or more carrier resins, one or more suspending agents, and a foaming agent. The carrier resins and the suspending agents may be used alone, or in combination with one another. The foaming agent is an ammonium salt of a polycarboxylic acid. The polymer may be any polymer commonly used in the art of investment casting.

The foaming compound is formed as follows: Between 75% and 99.9% by weight of the carrier resin, suspending agent, or combination thereof is mixed with between 0.1% and 25% by weight of an ammonium salt of a polycarboxylic acid. The constituents are then mixed until a homogeneous batch is achieved. Optionally, a quantity of ammonium bicarbonate, not to exceed 2% by weight of the foaming compound, may be added to reduce the decomposition temperature of the ammonium salt of the polycarboxylic acid. If the ammonium bicarbonate is added to the foaming compound, the temperature at which decomposition begins will be approximately 80° C.

The carrier resins or waxes which can be used to form the foaming composition include, but are not limited to, ethylene-ethyl-acrylate, polyethylene, polypropylene, high density polypropylene, polyethylene, nylon, and styrene-butadiene which is commonly sold under the trademark KRATON. The carrier resin or wax can be used alone or in combination with suspending agents. The purpose of the carrier resin is to aid in the transportation and handling of the ammonium salt of a polycarboxylic acid. Additionally, the carrier resin enables the ammonium salt of a polycarboxylic acid to be heat treated to form a stable solid composition.

The suspending agents, used alone or in combination with carrier resins in the formation of the foaming compound include, but are not limited to, hydrocarbon waxes, microcrystalline waxes, monoglycerides and triglycerides. The suspending agents serve to disperse the ammonium salt of a polycarboxylic acid throughout the mixture and prevent the occurrence of compositional gradients.

The ammonium salts of the polycarboxylic acids which can be used to form the foaming agent include, but arc not limited to, citric, oxalic, tartaric, tartronic, fumeric, malonic and maleic acid. Preferably, the foaming agent is ammonium citrate, ammonium maleate, or ammonium oxalate. Most preferably, the foaming agent is ammonium oxalate. Given its toxic nature, it is known to the artisan with ordinary skill that adequate precautions should be taken when using ammonium oxalate.

In a preferred embodiment, the foaming compound is subjected to a temperature of between approximately 35° C. and 90° C. at a pressure of between approximately 200 and 1200 psi to melt the compound. It is important to recognize that the temperature of this melt should not exceed 90° C.; for at this temperature the ammonium salt of the polycarboxylic acid begins to decompose. If a quantity, no greater than 2% by weight, of ammonium bicarbonate is added to the foaming compound, the temperature of the melt should be maintained at a temperature between approximately 35° C. and 80° C. to avoid decomposition of the ammonium salt of the polycarboxylic acid. After the compound has been heated to a flowable state, it is cooled and pelletized in accordance with normal industry procedure. Preferably, melting of the foaming compound is accomplished by use of an extruder. Upon exiting the die of the extruder, the compound is cut into pellets using a high speed cutter.

In an alternative preferred embodiment, an investment casting replica composition is formed by adding between approximately 0.1% and 10% by weight of the foaming compound to approximately between 90% and 99.9% by weight of a polymer. The polymer and foaming composition is then mixed, using conventional methods, until a homogeneous batch is achieved. The batch is then fed into an injection mold and subjected to a temperature of between 100° C. and 280° C., at a pressure of between 350 psi and 2200 psi. During the injection process, the ammonium salt of the polycarboxylic acid will decompose into gaseous $H_2O$, $CO_2$ and $NH_3$. Upon exiting the die of the injection mold and entering the metal mold, the rapid decrease in pressure will cause gaseous bubbles of $H_2$ O, $CO_2$ and $NH_3$ to form within the polymer. The polymer then foams in the metal mold, causing the replica to assume the desired shape within interior of the metal mold. Upon cooling of the molded replica, the gaseous compounds will form an ammonium carbonate product, leaving bubbles within the polymer.

When the replica is subsequently "burned out" of the ceramic mold, the ammonium carbonate compounds will again decompose into gaseous $H_2O$, $CO_2$ and $NH_3$ and exit the mold without leaving ash fragments on the ceramic surface surrounding the cavity. In addition, as the ammonium carbonate decomposes, the bubbles within the polymer will alleviate the pressure caused by the thermal expansion which in turn prevents the ceramic mold from cracking. Although not wishing to be bound by theory, what follows is reaction sequence believed to be responsible for the foaming ability of certain ammonium salts of polycarboxylic acids:

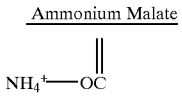

-continued

Ammonium Malate

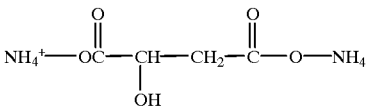

$\Delta$ $H_2O + 2NH_3 + CO_2 + \text{BY-PRODUCTS}$

COOL $NH_4HCO_3 + \text{BY-PRODUCTS}$

Ammonium Tartrate

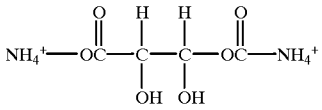

$\Delta$ $2NH_3 + 2CO_2 + \text{BY-PRODUCTS}$

COOL $NH_4HCO_3 + \text{BY-PRODUCTS}$

Ammonium Citrate

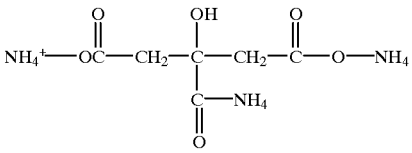

$\Delta$ $3NH_3 + CO_2 + H_2O + \text{BY-PRODUCTS}$

COOL $NH_4HCO_3 + \text{BY-PRODUCTS}$

Ammonium Oxalate

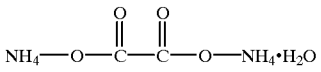

$\Delta$ $2NH_3 + 2CO_2 + 2H_2O$

COOL $2(NH_4)HCO_3$

The preferred pressure to be maintained throughout the injection process is approximately 1650 psi. The preferred temperature at the entrance of the injection mold is approximately 100° C. The interior of the injection mold is maintained at a temperature of between approximately 170° C. and 280° C., with the most preferred temperature being approximately 190° C. This temperature range is critical in that it enables complete decomposition of the ammonium salt of the polycarboxylic acid. It will be recognized that the exact temperature within the range of 170° C. and 280° C. at which complete decomposition takes place will vary slightly depending on the characteristics of the injection mold and will require a slight degree of experimentation common to those with ordinary skill in the art.

The polymers used in the formation of the investment casting replica composition are those normally used in the art, including, but not limited to, polycarbonates, nylon, high density polyethylene, polyethylene, polystyrene, and polypropylene. One with ordinary skill in the art will recognize that the choice of polymer will depend upon the desired characteristics of the casting composition, and that care must be taken to avoid using a polymer or polymers that are incompatible with the carrier resin.

It will be clear to those skilled in the art that many modifications and substitutions can be made without departing from the spirit and scope of the invention, which is defined by the appended claims.

What is claimed is:

1. A method of making a foamed investment casting replica, said method comprising the steps of:

mixing a polymer and a foaming compound to form a mixture, said foaming compound having a foaming agent selected from the group consisting of ammonium citrate, ammonium maleate and ammonium oxalate;

subjecting said mixture to a preselected temperature and a preselected pressure to cause said foaming agent to decompose into decomposition products; and introducing said mixture into an investment casting mold, said decomposition products forming gaseous bubbles in said polymer to form a foamed investment casting replica.

2. The method as recited in claim 1, wherein said polymer is present in an amount between approximately 90% and 99.9% by weight and wherein said foaming compound is present in an amount between approximately 0.1% and 10% by weight.

3. The method as recited in claim 1, wherein said preselected temperature is between approximately 100° C. and 280° C. and wherein said preselected pressure is between approximately 350 psi and 2200 psi.

4. The method as recited in claim 1, wherein said foaming compound further comprises a carrier resin.

5. The method as recited in claim 1, wherein said foaming compound further comprises a suspending agent.

* * * * *